US006454901B1

(12) United States Patent
Sekiya et al.

(10) Patent No.: US 6,454,901 B1
(45) Date of Patent: Sep. 24, 2002

(54) METHOD OF MAKING QUALITY CREPE PAPER

(75) Inventors: Kunio Sekiya; Hiroshi Sekiya, both of Tokyo (JP)

(73) Assignee: Maintech Co., Ltd., Tokyo (JP)

( * ) Notice: Subject to any disclaimer, the term of this patent is extended or adjusted under 35 U.S.C. 154(b) by 0 days.

(21) Appl. No.: 09/830,117

(22) PCT Filed: Aug. 22, 2000

(86) PCT No.: PCT/JP00/05612

§ 371 (c)(1),
(2), (4) Date: Apr. 24, 2001

(87) PCT Pub. No.: WO01/14131

PCT Pub. Date: Mar. 1, 2001

(30) Foreign Application Priority Data

Aug. 24, 1999 (JP) ..... 11-237649

(51) Int. Cl.[7] ..... B31F 1/12; D21F 27/00
(52) U.S. Cl. ..... 162/111; 162/112; 162/113
(58) Field of Search ..... 162/158, 111, 162/112, 113, 117; 264/282–284; 156/183

(56) References Cited

U.S. PATENT DOCUMENTS 3,014,832 A * 12/1961 Donnelly ..... 162/111
3,014,833 A * 12/1961 Lee ..... 162/111
3,017,317 A * 1/1962 Voigtman et al. ..... 162/111
5,338,807 A * 8/1994 Espy et al. ..... 525/430
5,370,773 A * 12/1994 Luu et al. ..... 162/111
5,571,382 A * 11/1996 Berglund ..... 162/198

FOREIGN PATENT DOCUMENTS

JP 61-12791 * 1/1986
JP 4-130190 * 5/1992

* cited by examiner

*Primary Examiner*—Jose Fortuna
(74) *Attorney, Agent, or Firm*—Sughrue Mion, PLLC

(57) ABSTRACT

The object of the present invention is to improve the adhesiveness of the paper body to the surface of a cylindrical Yankee dryer in the manufacturing process of crepe paper products in order to make a high-grade crepe form.

This is a manufacturing process of high-grade crepe paper products by attaching a paper body (P) to the surface of a rotating Yankee dryer (Y) and separating said paper body P through a doctor blade (D), wherein a crepe assistant (C) including 0.1 $\mu$g~10 $\mu$g/m$^2$ of molybdenum disulfide is continuously fed directly onto the surface of the cylindrical Yankee dryer (Y) while the paper body P is continuously fed to the cylindrical Yankee dryer.

An improvement in the adhesiveness of the paper body brought about a lower crepe ratio and enabled to manufacture high-grade crepe paper products provided with uniformly fine and delicate crepe "microholds."

5 Claims, 3 Drawing Sheets

METHOD OF MAKING QUALITY CREPE PAPER

TECHNICAL FIELD

This invention relates to a manufacturing process of crepe paper products and to a method of improving creping in the manufacturing process of crepe paper products in which a cylindrical Yankee dryer is used.

BACKGROUND ART

As the living standard improves in recent years, the demand for paper body provided with crepe such as facial tissue, bath tissue, etc. has risen.

This paper body P provided with crepe or crepe paper is manufactured by attaching a paper body (wet paper) to the surface of a heated Yankee dryer Y, drying the same for a certain period of time, and separating the paper body P from the cylindrical Yankee dryer Y through a doctor blade D (see FIG. 2).

Incidentally, R represents a winding roll, R1 a touch roll and R2 an auxiliary roll.

To be more specific, the paper body P accumulates potential crepe forming power in the process of drying up while it is attached to the smoothed surface of the dryer, and when it is separated from the surface of the cylindrical Yankee dryer by the doctor blade D, it forms instantly curved crepes.

Now, the formation of a paper body P with a good creping requires the adhesiveness (close contact) of the paper body to a heated cylindrical Yankee dryer Y, and its extent affects seriously the form of crepe.

In other words, it is known that, if the adhesiveness of the paper body to the cylindrical Yankee dryer is strong, the paper body P having been separated from the surface by the doctor blade forms fine and minute crepes (or "microhold") as shown in FIG. 3, and weak adhesiveness leads to the formation of course crepes (or "macroholds").

In addition, the more microholds are, the longer will be the length of the paper body produced (when no tension is applied) (the lower will be the crepe ratio), and the more productivity improves.

On the other hand , the more macroholds are , the shorter will be the length of the paper body produced (when no tension is applied) (the higher will be the crepe ratio), and the lower productivity falls.

It should be noted here that adhesiveness is said to be correlative with the smoothness of the dryer surface.

On the other hand, even under the impact of separation from the surface of the cylindrical Yankee dryer by the action of the doctor blade, an over-adhesion phenomenon of the paper body not separating from the surface and passing under the doctor blade occurs.

As a result, the surface of the paper body is damaged or the surface of the cylindrical Yankee dryer is stained.

This is a phenomenon that occurs due to a poor releasability of the paper body from the surface of the cylindrical Yankee dryer.

And this phenomenon become noticeable as the doctor blade gets increasingly worn out, and paper body that has been produced tend often to have macroholds constituting a qualitative disadvantage.

Therefore, in the normal operation, the doctor blades are replaced four to eight times a day (every three to six hours) constituting an issue for improving productivity.

Thus, it is necessary to guarantee contradicting matters, specifically the adhesiveness of the paper body to the surface of the cylindrical Yankee dryer and the releasability of the paper body from the surface of the cylindrical Yankee dryer.

In the meanwhile, an effective means used lately to improve productivity of paper with crepe is mainly to increase the surface speed of the cylindrical Yankee dryer, in other words to increase as much as possible the diameter of the cylindrical Yankee dryer.

However, the cylindrical Yankee dryers are made of casting from the viewpoint of thermal conductivity and temperature changes on the surface, and the larger the diameter of the cylindrical Yankee dryer is (at present some of them has a diameter of six meters or more), their surface tend to become softer.

When they become soft, the action of the doctor blades in contact with them causes naturally their surface to be worn and lose smoothness, and the paper body becomes less adhesive to the cylindrical Yankee dryer.

For these reasons, at present an adhesive, or a adhesive and a release agent are applied on the cylindrical Yankee dryer to fill the unevenness of the dryer surface and to form a coating layer consisting of a adhesive and a release agent. (See e.g. Japanese Patent Application Laid Open 2000-127597)

Although this method is certainly effective, but the coating layer formed by an adhesive is scraped by the doctor blade, the surface of the coating layer itself becomes course and the resulting deterioration of adhesivenss is a disadvantage.

Also the disadvantage of pulverized paper and adhesive cannot be treated lightly.

The present invention is made with an intent of solving these various issues.

In other words, the present invention has an object of improving the adhesiveness of the paper body to the surface of cylindrical Yankee dryer in the manufacturing process of paper body in which a cylindrical Yankee dryer is used and to make a high- quality crepe form.

DISCLOSURE OF THE INVENTION

Thus the inventors of the present invention kept up their efforts to overcome these issues.

As a result, they found that the continuous application of a release agent, an adhesive and a crepe assistant including solid lubricants on the surface of the cylindrical Yankee dryer resulted to their surprise in the development of a lubricant action between the doctor blade and the cylindrical Yankee dryer, and as a result the wear and tear of a film (coating layer) formed on the cylindrical Yankee dryer can be reduced to the minimum and the adhesion of the paper body can be improved. Based on this finding, they completed the present invention.

Specifically, the present invention relates to (1) a manufacturing process of crepe paper products by attaching a paper body on the surface of a rotating cylindrical dryer, separating said paper body from said surface through the doctor blade, wherein a crepe assistant including a fixed amount of solid lubricant is fed directly to the surface of the cylindrical Yankee dryer while the paper body is fed to the cylindrical Yankee dryer.

And (2) the present invention relates to the manufacturing method of high-quality crepe paper products according to item (1) wherein the solid lubricant is a lamellar crystal type solid lubricant.

And (3) the present invention relates to the manufacturing method of high-quality crepe paper products wherein the lamellar crystal type solid lubricant is molybdenum disulfide.

And (4) the present invention relates to the manufacturing process of high-quality crepe paper products according to item (3) wherein the powder size of molybdenum disulfide is within a range of 0.1 $\mu$m~10 $\mu$m.

And (5) the present invention relates to the manufacturing method of high-quality crepe paper products according to item (3) wherein the amount of solid lubricant fed is within a range of 0.1 $\mu$g–$\mu$g/m$^2$.

And (6) the present invention relates to a manufacturing method of high-quality crepe paper products wherein a paper body is attached to the surface of a rotating cylindrical Yankee dryer and then said paper body is separated from said surface through the doctor blade and a crepe assistant including molybdenum disulfide within a range of 0.1 $\mu$g–100 $\mu$g/m$^2$ directly on the surface of the cylindrical Yankee dryer when the paper body is fed to the cylindrical Yankee dryer.

And (7) the present invention relates to a manufacturing method of high-grade crepe paper products wherein a paper body is attached to the surface of a rotating cylindrical Yankee dryer and then said paper body is separated from said surface through the doctor blade and including the following steps 1) to 4):

1) The step of feeding a crepe assistant including a solid lubricant directly onto the surface of a rotating cylindrical Yankee dryer while the cylindrical Yankee dryer is operated to supply paper, the step of "supply chemicals";

2) The step of forming film by feeding a crepe assistant including a solid lubricant and filling fine unevenness on the surface of the cylindrical Yankee dryer, the step of "forming a film";

3) The step of producing a lubricating action between the doctor blade and the cylindrical Yankee dryer, the "lubrication step"; and 4) The step of filling the worn-out portion of the film by the crepe assistant including a solid lubricant fed, the step of "replenishing the film".

(Function)

The continuous provision of a fixed amount of crepe assistant including a solid lubricant onto the surface of the cylindrical Yankee dryer results in an efficient filling of fine unevenness on the surface of the dryer and the formation of a film (coating layer) smoothing its surface.

And at the same time, the solid lubricant contained in the crepe assistant fills fine unevenness of the surface.

On the other hand, the doctor blade is pressed against the film made of a crepe assistant in order to separate a paper body from the surface of the cylindrical Yankee dryer. The solid lubricant contained in the film, however, produces a lubricating effect between the doctor blade and the surface of the cylindrical Yankee dryer.

The further continued feeding of a crepe assistant replenishes a solid lubricant contained in the new crepe assistant to the worn-out film.

The present invention is described below by mentioning the mode of its carrying out and by referring to drawings.

In general, the paper body with crepe is made by attaching said paper body on the surface of the cylindrical Yankee dryer and by separating the same through the doctor blade.

As mentioned earlier, the paper body accumulates potential crepe forming power as it is heated while remaining attached to the smoothed surface of the dryer, and when it is separated by the doctor blade from the surface of the cylindrical Yankee dryer, it forms crepe instantly.

The method of improving creping according to the present invention is in principle applied to the cylindrical Yankee dryer. It improves the adhesiveness of the paper body to the dryer surface and improves the quality of the crepe form.

A method of improving the crepe form is to continue feeding a fixed amount of a crepe assistant including solid lubricant onto the surface of the cylindrical Yankee dryer.

In providing and feeding the crepe assistant, it is preferable to dilute the same with water, and spray the same over the entire width of the Yankee dryer.

This keeps a film (coating layer) of a crepe assistant including a solid lubricant formed on the dryer surface.

Here, for the solid lubricant, a lamellar crystal type is preferred in view of its low friction coefficient due to its cleavability.

As this lamellar crystal type, there are molybdenum disulfide, tungsten [di]sulfide, graphite fluoride, boron nitride, silicon nitride, etc., any one or two of which are used alone or in combination.

Among these, molybdenum disulfide with its fine particulate of 0.1 $\mu$m~10 $\mu$m has a potential power of cleaving into 1,600 pieces or more, and because of its low friction coefficient (approximately 0.04) and moreover its thermal and chemical stability, it is particularly preferable as a solid lubricant.

As the crepe assistant, a crepe assistant that has been traditionally used to improve creping is adopted.

A crepe assistant includes an adhesive and a release agent (mold release agent).

For the adhesive, epoxy resin which is a thermosetting resin, urea resin, and phenol resin are mentioned. Among these, it is particularly preferable to use epoxy resin by dispersing it in a solvent (water).

For the release agent (mold release agent), there are oils (mineral oils, synthetic oils, vegetable oils, animal oils, etc.).

It is preferable to use Polybdenum or paraffin wax.

For actually feeding a crepe assistant including said solid lubricant onto the dryer surface, a spray nozzle S is used.

The spray nozzle S is disposed as shown in FIG. 2 between the doctor blades D (position shown by a solid line), or behind the doctor blade D (nozzle shown by a chain line with two dots).

As for the amount of a crepe assistant including a solid lubricant or lubricants, as expressed in terms of solid lubricant, the amount of solid lubricant to be sprayed will be within a range of 0.1 $\mu$g~100 $\mu$g/m$^2$.

When the amount of crepe assistant to be sprayed is less than 0.1 $\mu$g/m$^2$, the crepe assistant does not attach in a sufficient quantity to the dryer surface, produces a relatively large amount of pulverized paper and the cycle of replacing the doctor blade becomes longer.

When the amount of crepe assistant to be sprayed exceeds 100 $\mu$g/m$^2$, the excess amount will be absorbed in wet paper, and the effect will be saturated in terms of crepe ratio and the cycle of doctor replacement.

Now, a series of steps for feeding a crepe assistant including a solid lubricant or lubricants directly to the dryer surface will be described below.

FIG. 1 is a schematic representation showing the principle of how the surface of a cylindrical dryer will be treated.

1) Step of Feeding Chemicals

When a crepe assistant (chemical) C including a solid lubricant I is fed to the cylindrical Yankee dryer Y, the endless belt (felt) presses with a fixed pressure a paper sheet to the dryer, and the crepe assistant C including the solid lubricant I fed to the dryer attaches to the dryer surface. (See A.)

The crepe assistant C including the solid lubricant I contains the solid lubricant 1, an adhesive and a release agent.

2) Step of Forming a Film

As a result of the continuous supply of the crepe assistant C including the solid lubricant 1, the crepe assistant C including the solid lubricant I attached to the dryer surface fills finely uneven parts (course areas) and forms a film (coating layer) several micron meters thick under heat and pressure applied (see B).

In this case, the solid lubricant I consisting of fine particles, as it is mixed in the crepe assistant, can easily penetrate evenly and in a large quantify into the fine uneven part of the dryer surface. Thus the solid lubricant is evenly distributed in the film.

Here, in the film (coating layer), a layer of release agent covering the film with adhesive (release mold agent layer 30) is formed (see B).

3) Lubrication Step

On the other hand, the film consisting of the crepe assistant C including the solid lubricant I formed on the surface of the cylindrical Yankee dryer Y is scraped by the doctor blade D at the same time as the paper body P is separated from said surface. On the other hand, the film brings about lubricant effect between the doctor blade D and the cylindrical Yankee dryer Y. and consequently reduces frictions with the cylindrical Yankee dryer.

As a result, the wear and tear of the film of crepe assistant C including solid lubricant I formed on the cylindrical Yankee dryer Y is reduced (see C).

In the meanwhile, when a paper body P is released from said surface, the layer of release agent (release mold agent layer 30) covering the upper side of the film contributes to release smoothly the paper body P.

4) Step of Replenishing the Film

As the supply of the crepe assistant C including the solid lubricant I still continues to the cylindrical Yankee dryer Y however, any decrease resulting from the scraping by said doctor blade D will be immediately replenished.

Incidentally, these actions 1) to 4) are not separated, but they are performed at the same time in harmony.

As described above, by continuing to supply the crepe assistant including the solid lubricants on the new dryer surface in motion while the cylindrical Yankee dryer is operating, at the initial stage, the steps 1) and 2) described above are executed.

Then, by continuing to supply the crepe assistant including the solid lubricant, the steps 3) to 4) described above are executed.

By passing through these four steps, i.e. the step of feeding chemicals, the step of forming a film, the lubrication step and the step of replenishing film, the function of feeding chemicals, the function of filling uneven parts, the function of lubricating between the dryer and the doctor blade and the function of replenishing the worn out film are performed.

As a result, on the dryer surface a film of crepe assistant including a fixed amount of solid lubricant will be always maintained stably.

As the solid lubricant is uniformly dispersed in this film, while the doctor blade remains pressed against the surface of the cylindrical dryer in order to separate the paper body from the cylindrical Yankee dryer, a so-called lubricating effect takes place between the cylindrical Yankee dryer and the doctor blade reducing frictions and preventing possible wear of the doctor blade.

As the film contains uniformly distributed solid lubricants, it will be very strong and robust.

Consequently, the amount of scraping by the doctor blade on the surface of the cylindrical Yankee dryer will be reduced and the wear and tear of the film will decrease.

In addition, when the paper body is separated by the doctor blade from the cylindrical Yankee dryer, an advantage of the system of the present invention is that the solid lubricant contributes to the release action.

As a result, the function of the release agent contained in the crepe assistant can be performed. According to the present invention, it is possible to adopt a crepe assistant that does not necessarily contain a release agent.

On the other hand, the surface of the film showing a low level of friction is always flat and smooth assuring an adhesiveness for the paper body and the formation of fine and uniform crepes.

And when the paper body is released from the surface of the cylindrical Yankee dryer, the release agent covering the upper side of the film functions assuring releasability.

(Effect)

To sum up, the present invention has at least the following advantages.

As the adhesiveness of the paper body to the cylindrical Yankee dryer improves, crepe ratio falls down and high-grade crepe paper products provided uniformly with fine and delicate crepe or "microholds" can be produced.

In the course of manufacturing, the amount of pulverized paper generated is limited, and the time consumed for cleaning machines is reduced.

The cycle of replacing doctor blades becomes longer and productivity improves.

The electric power required to drive the dryer is reduced contributing to the economy of energy and cost reduction.

The best mode for Carrying out the Invention

As for the amount of crepe assistant including solid lubricant to be sprayed, it is necessary to spray little by little over the dryer surface, but the amount sprayed as expressed in terms of solid lubricant varies within a range of 0.1 $\mu$g~100 $\mu g/m^2$.

The test results of their spraying will be shown in the Examples below.

It should be noted however that the present invention is not necessarily limited to the Examples shown below:

EXAMPLE 1

After 48 hours of spraying continuously a crepe assistant [consisting of an adhesive (epoxy resin liquid) and a release agent (mineral oil)] including a solid lubricant (molybdenum disulfide) from the nozzle of a sprayer onto the surface of a cylindrical Yankee dryer (made by Kawanoye Industrial Co., Ltd.) used to manufacture crepe paper product (facial tissue), the dryer surface, the generation of pulverized paper, crepe ratio, the interval of replacing the doctor blades (replacement cycle) and the power for driving the dryer were observed.

Crepe paper (facial tissue): basis weight: 13 g

Paper width: 2,000 mm (2 m)

Paper processing speed: 730m/min.

Crepe Assistant Used Including Solid Lubricant

The crepe assistant used here is a mixture of an aqueous solution of epoxy resin (AD400 (made by M)) and a solution obtained by diluting 1,000 times a mineral oil liquid (DSL200 (made by M)) by water.

The ratio (by weight) of the aqueous solution of epoxy resin and the mineral oil liquid before dilution is 1:2.5.

And the solid lubricant used is molybdenum disulfide, while the ratio (by weight) of the aqueous solution of epoxy resin and the solid lubricant added to the aqueous solution of epoxy resin is 40:1.

Amount Sprayed

And a fixed amount of a crepe assistant including a solid lubricant as mentioned above was fed (0.01 g/min. taking molybdenum disulfide as the standard).

Specifically, the amount of solid lubricant sprayed (amount fed) over the area of paper body fed to the Yankee dryer was 6.85 $\mu g/m^2$.

$$*(0.01\ g/min)/(2\times730\ m/min)=6.85\ \mu g/m^2$$

Results Obtained After operating under the conditions mentioned above were as follows.

Results

Figure 1A:
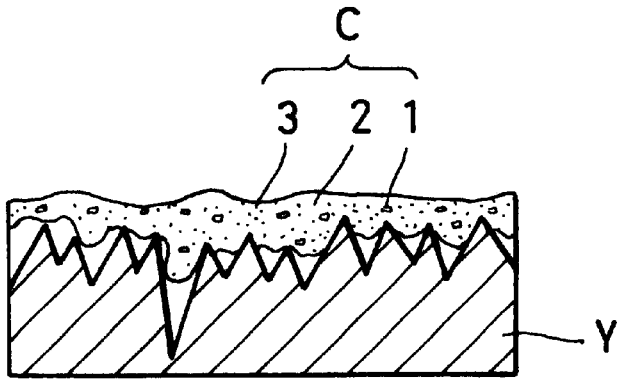
FIG. 1 is a schematic functional illustration showing some principles of how the dryer surface is treated.
Figure 1B:
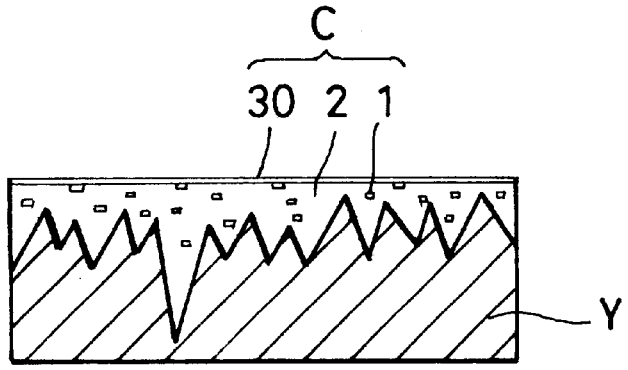
Figure 1C:
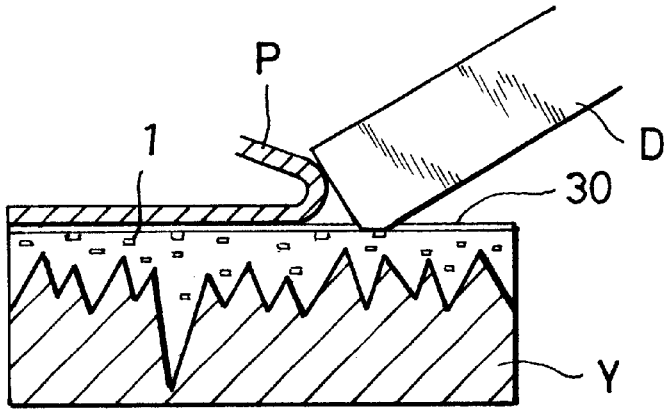
Figure 2:
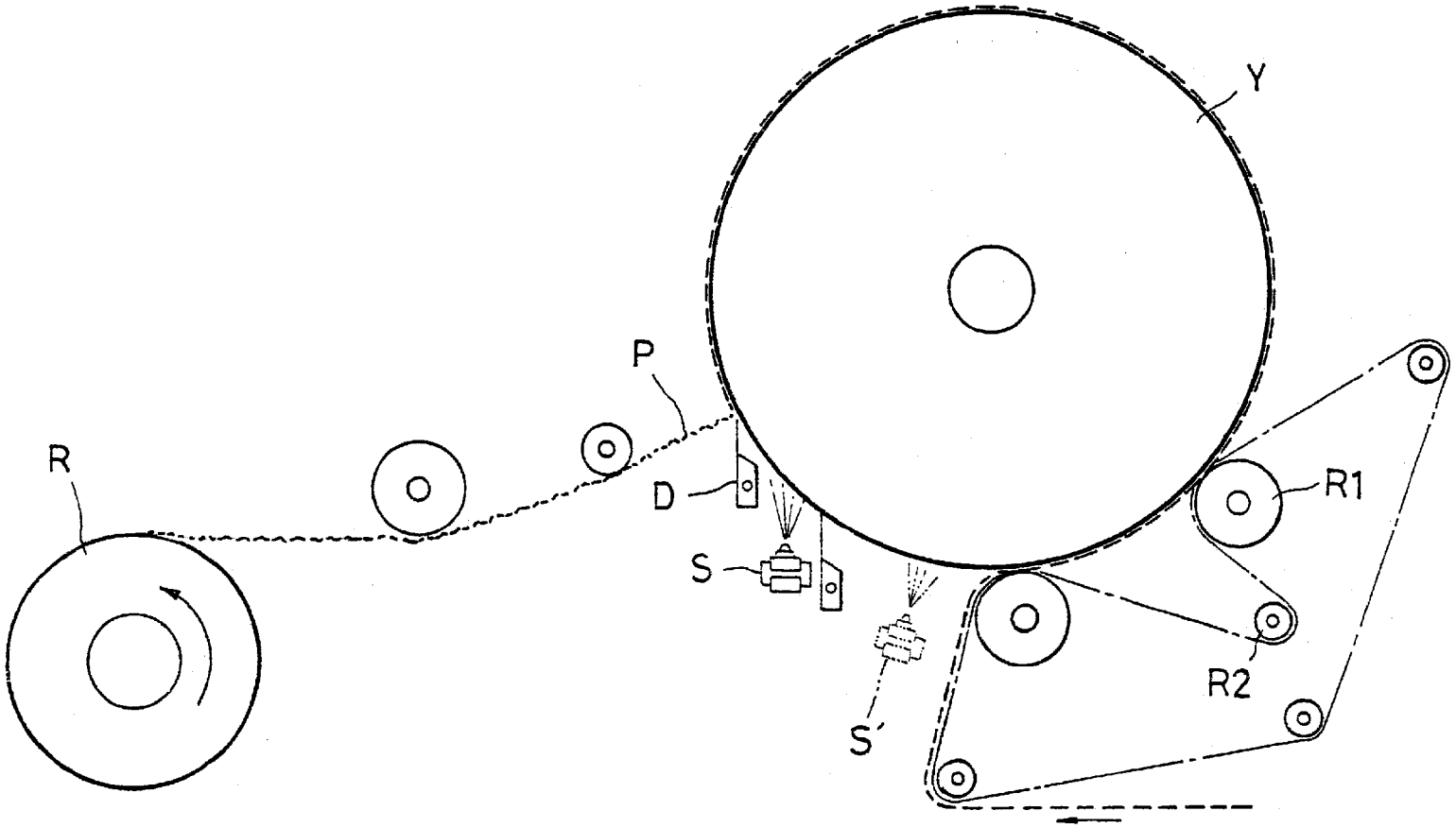
FIG. 2 is a schematic view showing the manufacturing method of crepe paper products by using a Yankee dryer.
Figure 3:
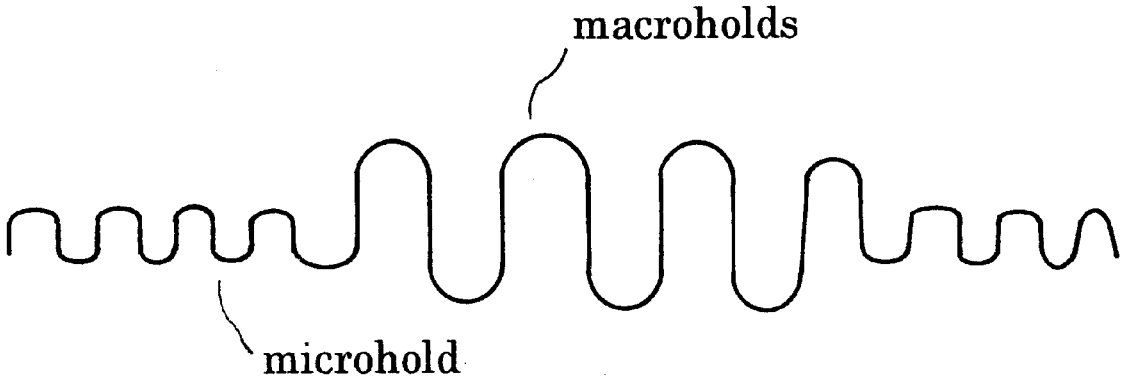
FIG. 3 is a schematic view showing the microholds and macroholds in a crepe paper product.

The dryer surface looks like a mirror, and as shown in FIG. 1, exceedingly good results were obtained as compared with the prior example 1 in terms of the appearance of pulverized paper, crepe ratio, replacement interval of doctor blades and the power required for driving the dryer.

EXAMPLE 2

Tests were conducted by reducing the amount sprayed from that of Example 1 (the amount sprayed was 0.0002 g/min. taking molybdenum disulfide as the standard).

Specifically, the amount of solid lubricant sprayed (amount fed) was 0.14 $\mu g/m^2$.

Results.

The dryer surface looks like a mirror, and as shown in FIG. 1, exceedingly good results were obtained as compared with the prior example 1 in terms of the appearance of pulverized paper, crepe ratio, replacement interval of doctor blades and the power required for driving the dryer.

However, the results were somewhat inferior to those of Example 1.

EXAMPLE 3

Tests were conducted by increasing the amount sprayed in Example 1 (the amount sprayed was 0.1 g/m in. taking molybdenum sulfide as the standard)

Specifically, the amount of solid lubricant sprayed (amount fed) was 68.5 $\mu g/m^2$.

Results

The dryer surface looks like a mirror, and as shown in FIG. 1, exceedingly good results were obtained as compared with the prior Example 1 in terms of the appearance of pulverized paper, crepe ratio, the replacement interval of doctor blades and the power required for driving the dryer.

Compared with Example 1, however, there were no great differences other than those related to power consumption.

EXAMPLE 4

Tests were conducted by increasing the amount sprayed in Example 1 (the amount sprayed was 0.15 g/min. taking molybdenum sulfide as the standard)

Specifically, the amount of solid lubricant sprayed (amount fed) was 102.75 $\mu g/m^2$.

Results

In general, as shown in Table 1, the results obtained were not much different from those of Example 3.

Example for comparison 1

Similar tests were conducted in Example 1 by using an organic solid lubricant other than lamellar crystal type [MCA (melamine cyanurate)] in place of molybdenum disulfide (the amount sprayed was 0.05 g/min. taking MCA as the standard).

Specifically, the amount of solid lubricant sprayed (amount fed) was 34.25 $\mu g/m^2$.

Results

The dryer surface is relatively course, and as shown in FIG. 1, the results obtained were somewhat inferior to Examples 1 through 4 in terms of the appearance of pulverized paper, crepe ratio, the replacement interval of doctor blades and the power required to drive the dryer.

Example for comparison 2

Similar tests were conducted in Example 1 by using the same crepe assistant but without adding any solid lubricant (the amount of crepe assistant sprayed was the same as in Example 1).

Specifically, the amount of solid lubricant sprayed (amount fed) was nil.

Results

The dryer surface was very course and rugged, and as shown in FIG. 1, the results obtained were extremely bad as compared with Examples 1 through 4 in terms of the appearance of pulverized paper, crepe ratio, the replacement interval of doctor blades and the power required to drive the dryer.

TABLE 1

| | Replacement cycle of doctor blades | Crepe ratio (%) | Pulverized paper (compared with Example for comparison 2) | Power to drive the dryer (KW/h) |
|---|---|---|---|---|
| Example 1 | 32 | 12.5 | 1/10 | 174 |
| Example 2 | 12 | 13.5 | 1/5 | 178 |
| Example 3 | 36 | 12.0 | 1/10 | 172 |
| Example 4 | 38 | 12.0 | 1/10 | 172 |
| Example for comparison 1 | 6 | 15.0 | 1/3 | 185 |
| Example for comparison 2 | 4 | 15.0 | 1* | 185 |

*5 Kg/24 hours

So far, the present invention has been described, but the present invention is not limited to the examples of carrying out given above, and it is needless to say that other various variations are possible to the extent that they do not deviate from the essence.

For example, a cylindrical Yankee dryer was shown for explanation on the dryer. However, the present invention can be applied to any means of manufacturing a paper body with crepe by releasing the same from a dryer through a doctor blade.

And in the examples given above, the case of facial tissue was cited as an example of paper body to which the present invention can be applied. The inventors have confirmed similar effects on bath tissues, however.

INDUSTRIAL APPLICABILITY

As described above, the manufacturing process of high-grade crepe paper products related to the present invention is a technology applicable to the manufacturing method of crepe paper products by means of the cylindrical Yankee dryer. However, it is applicable to the entire technological field of the paper making industry to the extent that similar effects can be expected therefrom.

What is claimed is:

1. A method of manufacturing high-grade crepe paper products by attaching a paper body to the surface of a rotating cylindrical dryer and separating said paper body from said surface through a doctor blade, wherein a crepe assistant including a fixed amount of molybdenum disulfide and an adhesive is continuously fed directly to the surface of the cylindrical Yankee dryer while the paper body is fed to the cylindrical Yankee dryer.

2. The manufacturing method of high-grade crepe paper products according to claim 1 wherein the particle size of molybdenum disulfide is within a range of 0.1 $\mu$m to 10 $\mu$m.

3. The manufacturing method of high-grade crepe paper products according to claim 1 wherein the amount of molybdenum disulfide fed is within a range of 0.1 $\mu$g to 100 $\mu g/m^2$.

4. A method of manufacturing high-grade crepe paper products by attaching a paper body to the surface of a rotating cylindrical dryer and separating said paper body from said surface through a doctor blade, wherein a crepe assistant including 0.1 $\mu$g to 100 $\mu g/m^2$ of molybdenum disulfide is continuously fed directly to the surface of the cylindrical Yankee dryer while the paper body is fed to the cylindrical Yankee dryer.

5. A method of manufacturing high-grade crepe paper products by attaching a paper body to the surface of a rotating cylindrical dryer and then separating said paper body from said surface through a doctor blade, said method comprising:

1) the feeding step of feeding a crepe assistant including a molybdenum disulfide and an adhesive directly to the surface of a rotating cylindrical Yankee dryer while paper is fed by the operation of the cylindrical Yankee dryer;

2) the step of forming a film by feeding a crepe assistant including the molybdenum disulfide and the adhesive and filling fine uneven parts of the surface of the cylindrical Yankee dryer;

3) the step of filing creating a lubricating effect between the doctor blades and the cylindrical Yankee dryer; and 4) the step of filling any worn out parts of the film with the crepe assistant including the molybdenum disulfide and the adhesive fed.

* * * * *